United States Patent [19]

Caputo et al.

[11] 4,308,936

[45] Jan. 5, 1982

[54] ELEVATOR SYSTEM

[75] Inventors: William R. Caputo, Wyckoff; John J. De Lorenzi, Washington, both of N.J.

[73] Assignee: Westinghouse Electric Corp., Pittsburgh, Pa.

[21] Appl. No.: 122,339

[22] Filed: Feb. 19, 1980

[51] Int. Cl.[3] ..... B66B 5/02

[52] U.S. Cl. ..... 187/29 R

[58] Field of Search ..... 187/29

[56] References Cited

U.S. PATENT DOCUMENTS

| | | | |
|---|---|---|---|
| 3,587,785 | 6/1971 | Krauer et al. | 187/29 |
| 3,741,348 | 6/1973 | Caputo | 187/29 |
| 3,902,572 | 9/1975 | Ostrander | 187/29 |
| 4,019,606 | 4/1977 | Caputo et al. | 187/29 |
| 4,085,823 | 4/1978 | Caputo et al. | 187/29 |
| 4,101,007 | 7/1978 | Magee | 187/29 |
| 4,114,731 | 9/1978 | Faup et al. | 187/29 |

*Primary Examiner*—B. Dobeck
*Assistant Examiner*—W. E. Duncanson, Jr.
*Attorney, Agent, or Firm*—D. R. Lackey

[57] ABSTRACT

An elevator system including a comparator which develops a control signal responsive to the actual versus the designed performance of the elevator car as it approaches a floor at which it is to stop. This control signal is used in a monitoring and protective arrangement which controls pre-opening of the doors before the elevator car stops at a floor, as well as providing additional protection relative to the operation of the elevator car after it has made an inaccurate landing, and back-up protection for any movement of the elevator car with its doors open.

8 Claims, 7 Drawing Figures

ELEVATOR SYSTEM

BACKGROUND OF THE INVENTION

1. Field of the Invention

The invention relates in general to elevator systems, and more specifically to protective and monitoring arrangements for elevator systems which monitor the landing of an elevator car at a target floor.

2. Description of the Prior Art

An elevator car should consistently and reliably make smooth, accurate stops at the floors of the building it is serving, within predetermined velocity and deceleration ranges, and with appropriate operation of the car and hatch doors. Instead of waiting for the elevator car to stop level with a target floor before initiating the opening of the car and hatch doors, it is common to pre-open the doors in order to reduce floor-to-floor time and thus improve efficiency and service in a building. Pre-opening of the elevator doors is conventionally initiated when the elevator car is a predetermined distance from the floor, such as a distance in the range between two and ten inches, if the car speed at this point is below a predetermined magnitude, such as 150 FPM. A predetermined period of time after the doors are to open, such as 1.5 seconds, the elevator car must be within a predetermined distance from floor level, such as two inches, and traveling less than a predetermined speed, such as less than 30 FPM. If these requirements are not met, certain modifications to the normal operation of the elevator system may be instituted, such as by limiting the car speed and/or stopping the car and preventing it from being restarted until checked by operating personnel, as disclosed in U.S. Pat. Nos. 3,741,348 and 3,802,274, which are assigned to the same assignee as the present application. Additional monitoring functions provide back-up protection, such as monitors which check the armature voltage, and rate of change of armature voltage, of the drive motor, and, as disclosed in our U.S. Pat. No. 4,085,823, a monitor which constantly compares actual car velocity with the expected car velocity based upon the command or speed pattern signal. This latter monitoring function is especially accurate because the difference signal is unlike the error developed in response to the difference between the command signal and the car velocity. The conventional error signal is necessarily large during certain portions of the acceleration and deceleration phases, and thus a detector which monitors the magnitude of the error signal would have to be set to a relatively large magnitude in order to avoid nuisance tripping. On the other hand, comparing actual and expected car speeds enables a monitor which monitors the difference signal to be set to a relatively small value, as these two signals will normally track very closely at all stages of a run, when the elevator system is operating normally. This monitor, however, is not designed to recognize a failure in the command signal.

SUMMARY OF THE INVENTION

Briefly, the present invention is a new and improved elevator system which provides improved monitoring and protective functions related to the pre-opening of the elevator car door and hatch door as an elevator car approaches a target floor, and back-up protection during stretch-of-cable releveling. A pseudo velocity generator, independent of the normal speed pattern generator, is provided which generates a signal which starts when the elevator car reaches the landing zone, such as about ten inches from the level of the target floor. The magnitude of the pseudo velocity signal is responsive to the design velocity magnitude of the elevator car in the landing zone. Thus, if the elevator system is operating as designed, there will be little or no difference between this pseudo velocity signal and a signal responsive to the actual velocity of the elevator car in the landing zone. The difference between the pseudo velocity signal and a signal responsive to actual car velocity is compared with a reference signal. The reference signal is set to a magnitude which indicates the allowable speed variation from design speed within which pre-opening of the doors is allowed. If the difference signal exceeds the reference signal at the start of the landing zone, a decision is immediately made to inhibit door opening until the elevator car has come to a complete stop at the target floor.

If the difference signal is less than the reference signal at the start of the landing zone, the pre-opening feature is enabled. Actual pre-opening of the doors may then be immediately initiated, if desired, or door pre-opening may be initiated when the elevator car reaches any desired closer location to the target floor. If door pre-opening is not initiated at the start of the landing zone, the monitoring feature may reverse its original decision to allow door pre-opening if the difference signal exceeds the reference signal at any time between the start of the landing zone and the start of the inner zone which initiates door pre-opening.

If door pre-opening is enabled when the elevator car reaches the location at which it is desirable to start the pre-opening procedure, door pre-opening is initiated. If the difference signal should exceed the reference signal after door pre-opening has been initiated, the operation of the elevator system is modified, such as by reclosing the doors if the elevator car is not within a predetermined distance from floor level, and by making an emergency stop which includes applying the brake on the drive motor.

In a preferred embodiment of the invention, a two step or two level reference signal is utilized in order to lessen the probability of having to make an emergency stop. The first level of the reference signal is a relatively small magnitude signal which ensures that the actual car velocity is closely tracking the designed velocity before enabling door pre-opening. If it is not tracking this closely, door pre-opening is simply inhibited. If, however, the actual velocity is closely tracking the designed velocity, door pre-opening is initiated, and once initiated the reference signal is increased to a second or higher level, thus requiring a greater difference between the actual and designed car velocities before an emergency stop is initiated.

The control elements of the protective and monitoring circuits are reset once the elevator car stops at floor level, by forcing the pseudo velocity signal to a relatively high magnitude, which provides a large difference signal. The large difference signal exceeds the reference signal, forcing the inhibit signal to be generated. If this inhibit signal is not provided at the start of a run, the car running circuits are disabled.

The pseudo velocity signal is smoothly reduced from one polarity to zero, and it then continues through zero to provide a small signal having the opposite polarity. This opposite polarity signal is thus provided after the elevator car would normally have come to a stop. This opposite polarity signal adds to the actual velocity signal, to cause the difference signal to exceed the reference magnitude at a lower actual car speed. Thus, if the elevator car for some reason does not make an accurate landing, its maximum allowable speed while re-leveling into the floor will be reduced, with an emergency stop being made if the car exceeds this speed.

BRIEF DESCRIPTION OF THE DRAWING

The invention may be better understood, and further advantages and uses more readily apparent, when considered in view of the following detailed description of exemplary embodiments, taken with the accompanying drawings, in which.

DESCRIPTION OF PREFERRED EMBODIMENTS

Figure 1:
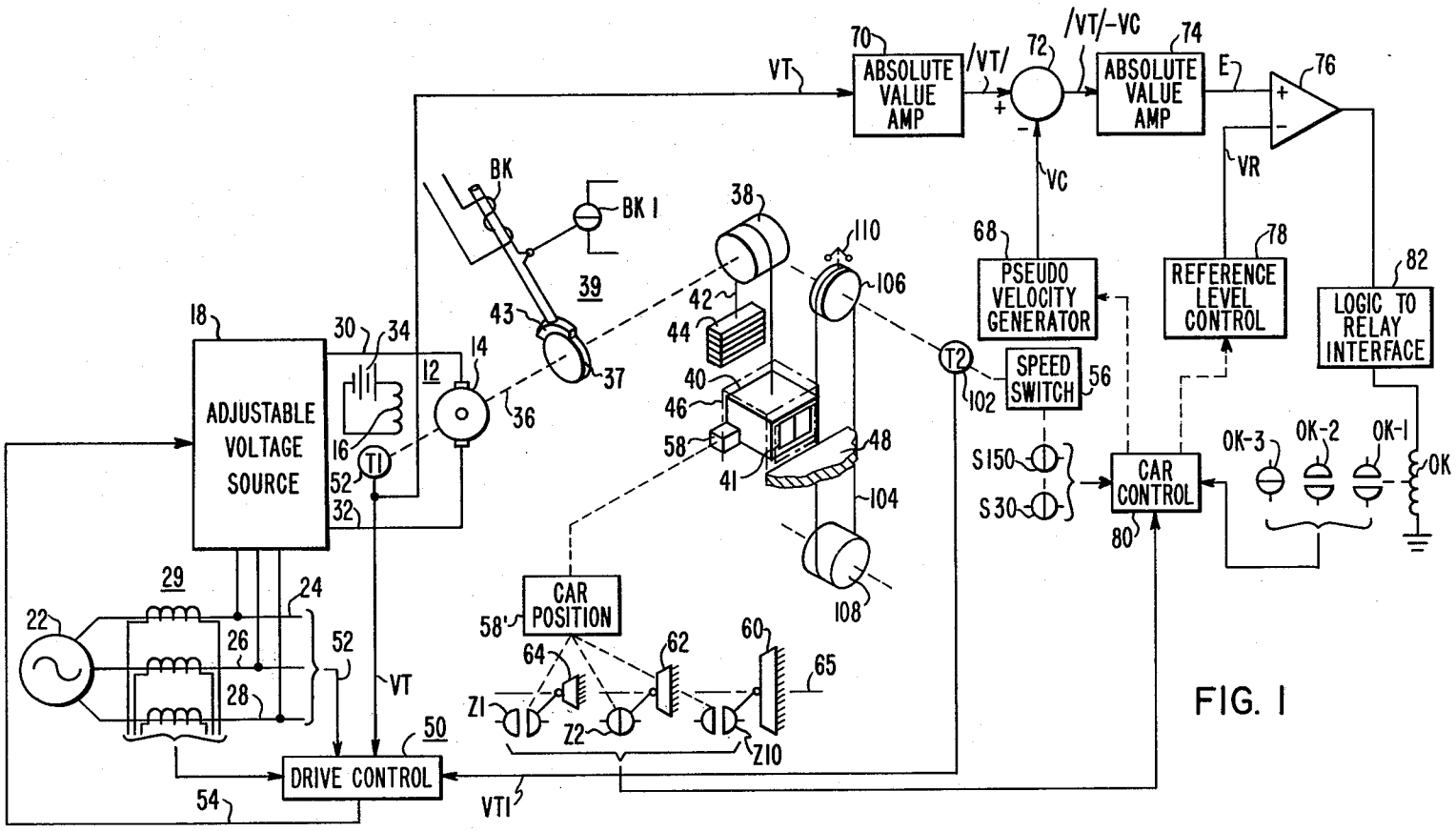
FIG. 1 is a partially schematic and partially block diagram of an elevator system constructed according to the teachings of the invention.

As an aid to understanding the drawings, the relays and switches shown in the various figures are identified as follows:

BK—brake solenoid coil
CD—car door switch
CPR—emergency stop relay
HD—hatch door switch
L2—landing zone relay
L2X—auxiliary landing zone relay
L4—inner zone relay
OK—speed difference in landing zone relay
RH—running relay
S30—30 FPM speed switch
S150—150 FPM speed switch
X—door pre-open enable relay
Z1—$\pm\frac{1}{4}$ inch switch
Z2—$\pm 2$ inch switch
Z10—$\pm 10$ inch switch
3R—running relay
40R—car door relay
41R—hatch door relay
45R—door open/close relay
80R—call relay Referring now to the drawings and to FIG. 1 in particular, there is shown an elevator system 10 which includes a drive motor, such as a direct current drive motor 12 having an armature 14 and a field winding 16. The armature 14 is electrically connected, via suitable line contactors, to an adjustable source 18 of direct current potential. The source of potential may be direct current generator of a motor-generator set in which the field of the generator is controlled to provide the desired magnitude of unidirectional potential; a static source, such as a dual converter; or, an adjustable A.C. source, in which event the drive motor would be an A.C. motor, such as an induction motor. For purposes of example, it will be assumed that source 18 is a static source as shown and described in detail in our U.S. Pat. No. 4,085,823. This patent also discloses an arrangement for developing signals responsive to actual car speed.

In order to simplify the drawings and description, only the portions of an elevator system which are necessary in order to understand our invention are shown in detail. Detailed arrangements for providing car position signals in the landing zone adjacent to a target floor are set forth in U.S. Pat. No. 4,019,606. U.S. Pat. No. 3,802,274 discloses a speed switch for developing car speed signals for use in the landing zone. U.S. Pat. No. 3,902,572 sets forth car control circuits which may be used. Thus, U.S. Pat. Nos. 4,085,823, 4,019,606, 3,802,274 and 3,902,572, all of which are assigned to the same assignee as the present application, are hereby incorporated into the present application by reference.

The drive machine of the elevator system 10 includes an alternating current portion comprising a source 22 of alternating potential and buses 24, 26 and 28. The direct current portion of the drive machine includes buses 30 and 32, to which the armature 14 of the direct current motor 12 is connected. The field winding 16 of drive motor 14 is connected to a source 34 of direct current voltage, represented by a battery in FIG. 1, but any suitable source such as a single bridge converter may be used.

The drive motor 12 includes a drive shaft indicated generally by broken line 36, to which a brake drum 37 and a traction sheave 38 are secured. An elevator car 40 having a door 41 is supported by a plurality of ropes 42 which are reeved over the traction sheave 38, with the other ends of the ropes being connected to a counterweight 44. The elevator car is disposed in a hoistway 46 of a structure or building having a plurality of floors or landings, such as floor 48, which floors are served by the elevator car. Each floor includes a hatch door which is operated in unison with the elevator door 41, when the elevator car 40 is at the associated floor. The brake drum 37 is part of a brake system 39 which includes a brake shoe 43 which is spring applied to the drum 37 to hold the traction or drive sheave 38 stationary, and it is released in response to energization of a brake solenoid coil BK. When the brake is applied, a contact BK-1 is closed, and when the brake is picked up, contact BK-1 is open, which contact is utilized in the control circuits.

The movement mode of the elevator car 40 and its position in the hoistway 46 are controlled by the voltage magnitude applied to the armature 14 of the drive motor 12. The magnitude of the direct current voltage applied to armature 14 is responsive to a velocity command signal provided by a suitable speed pattern generator located in the drive controls shown generally at 50. The servo control loop for controlling the speed, and thus the position of car 40 in response to the velocity command signal, also included in drive control 50, may be of any suitable arrangement such as shown in our U.S. Pat. No. 4,085,823. Current feedback for the drive control 50 is provided by current transformers 29, synchronizing or timing signals are provided from the A.C. buses, as indicated by conductor 52, and firing pulses for the controlled rectifier devices of the static source 18 are provided by drive control 50, as indicated by conductor 54.

As disclosed in our U.S. Pat. No. 4,085,823, two tachometers T1 and T2 may be used in a self-checking manner to provide car speed information; or, a single tachometer may be used, as desired. For example, if two tachometers are used, a signal VT responsive to the actual speed of the elevator drive motor 12 may be provided by a first tachometer 52. Tachometer 52 may be coupled to the shaft of the drive motor 12 via a rim drive arrangement. A signal VT1 responsive to the actual speed of the elevator car 40 may be provided by a second tachometer 102. The second tachometer 102 may be driven from the governor assembly which includes a governor rope 104 connected to the elevator car 40, reeved over a governor sheave 106 at the top of the hoistway 46, and reeved over a pulley 108 connected to the bottom of the hoistway. A governor 110 is driven by the shaft of the governor sheave, and the tachometer 102 may also be driven by the shaft of the governor sheave 106, such as via a belt drive arrangement. The present invention utilizes a signal responsive to the speed of the elevator car. If a two tachometer, self-checking arrangement is utilized, signal VT from the rim driven tachometer 52 may be used, because it provides a "cleaner" signal electrically. However, signal VT1 may be used, if desired, since the present invention does not require that the tachometer signal be differentiated.

FIG. 1 illustrates a car speed switch 56 driven by the elevator system, such as belt driven from the governor sheave 106, with U.S. Pat. No. 3,802,274 illustrating such a speed switch. Speed switch 56 provides independent indications of car speed for use in the landing zone, with a contact set S150 opening when the car speed is less than 150 FPM, and a contact set S30 opening when the car speed is less than 30 FPM. Our U.S. Pat. No. 4,085,823 also discloses developing such signals electrically from the two tach self-checking arrangement.

Car position signals relative to the landing zone adjacent to each floor are indicated as being provided by car position means 58, which, as illustrated adjacent to block 58', may be provided by cams and switches. For example, cams 60, 62 and 64 may be disposed on suitable cam tapes strung in the hoistway, with the cams being attached to the tapes adjacent to each floor. Switches Z10, Z2 and Z1 are mounted on the elevator car 40 and oriented to make contact with cams 60, 62 and 64, respectively. Switch Z10 and cam 60 define the limits of the landing zone, which will be assumed to extend ten inches in each diretion from floor level, with the floor level being indicated by broken line 65. Switch Z10 is normally closed, opening its contacts only when the floor of the passenger compartment of the elevator car is within the landing zone, i.e., the floor of the passenger compartment in the elevator is within ten inches from the target floor with the "target floor" being a floor at which the elevator car 40 is preparing to make a stop. Switch Z2 is normally open, closing its contacts only when the elevator car is within two inches from floor level. Switch Z2, for example, may be used to initiate pre-opening of the door 41, or door pre-opening may be initiated earlier, such as in response to actuation of switch Z10. Switch Z1 is normally closed, opening only when the elevator car is within $\pm 0.25$ inch of floor level. Switch Z1 may be used to initiate re-leveling, such as due to stretch or contraction of the ropes 42 as passengers enter or leave the elevator car. The same signals provided by switches Z10, Z2 and Z1 may be developed opto-electronically, as disclosed in U.S. Pat. No. 4,019,606, or in any other suitable manner.

The present invention develops a completely separate speed pattern signal VC in a circuit termed a pseudo velocity generator 68. The pseudo velocity generator 68 is completely independent of the conventional speed pattern signal which is located in the drive control 50. The pseudo velocity signal VC is not the same as the normal speed pattern or command signal, as it provides a signal which represents the designed response to the command signal. Further, the pseudo velocity generator only provides the signal VC in the landing zone. Thus, signal VC may be initiated by switch Z10, with the magnitude of signal VC starting at the designed velocity of the elevator car as it reaches the ten inch point while it is slowing down or decelerating to land at the associated floor. Its magnitude is smoothly reduced to zero to indicate the designed or expected velocity of the elevator car as it decelerates into floor level. As will be hereinafter explained, in a preferred embodiment of the invention, signal VC continues through zero to provide a small signal of opposite polarity, which provides additional protection during an subsequent movement of the elevator car with the doors open.

A signal proportional to the actual speed of the elevator car, such as signal VT, or signal VT1, is applied to an absolute value circuit 70 to provide a signal $|VT|$. The pseudo velocity signal VC is subtracted from signal $|VT|$ in a summing junction 72 to provide a difference signal $|VT|-VC$. If the speed of the elevator car in the landing zone is the same as the expected or designed speed signal, $|VT|-VC$ will be close to zero. If the elevator car is moving slower than the designed speed, or faster, it may stop short of, or overshoot, respectively, the floor level, and thus signal $|VT|-VC$ may have a positive or a negative polarity. Thus, this signal is applied to an absolute value circuit 74, providing a positive polarity signal E equal to the difference between $|VT|$ and VC.

Signal E is applied to a comparator 76, which, as illustrated, may be an operational amplifier (op amp). Signal E is applied to the non-inverting input of op amp 76. A reference signal VR from reference level control 78 is applied to the inverting input of op amp 76. Signal E is unlike the conventional error signal produced by summing the speed command signal and a signal responsive to actual car speed, as the conventional error signal has relatively large magnitudes during transition periods at the start of acceleration and deceleration. On the other hand, signal E will always have a very small value when the elevator car speed has the proper magnitude and rate of change in the landing zone. Thus, reference signal VR may be set to detect relatively small deviations of the actual car speed from the design speed. This close control is utilized to advantage in a preferred embodiment of the invention by providing a signal VR which has a relatively low magnitude up until the time door pre-opening is actually initiated, and then by increasing the magnitude of signal VR to a predetermined higher level once the doors start to open. An emergency stop, while landing, is only made when the elevator car exceeds a predetermined speed with the doors open. The present invention reduces the probability of an emergency stop by requiring that the actual car speed be tracking the desired speed more closely than the speed deviation which will cause an emergency stop when the doors are open. If it is not tracking this closely, door pre-opening is inhibited. If it is tracking within these close limits, door pre-opening is allowed, and once the doors start to open, the reference level is set to the normal value used to initiate an emergency stop with the doors open. Thus, if the actual car speed is tracking the design speed more closely than required after the doors start to open, the probability of the speed deviation reaching the emergency stop level is greatly reduced.

The output of op amp 76 will be at the logic zero level as long as the difference signal or speed error E is less than the reference level provided by signal VR. Should the speed error E exceed the reference, indicating the actual car speed has deviated from the design speed, to or beyond the allowable deviation, the output of op amp 76 will switch to the logic one level. If the car control, shown generally at 80, is of the solid state type, the logic output of op amp 76 may be used directly. If car control 80 uses electromechanical relays, a logic voltage level to relay voltage level interface circuit 82 may be used to operate an electromechanical relay OK. Interface 82 is designed such that relay OK will be energized when the difference or error signal E is less than the reference VR, and de-energized or dropped out when signal E exceeds reference VR. For purposes of example, car control 80 will be assumed to be of the electromechanical relay type, with relay OK having n.o. contacts OK-1, and OK-2, and n.c. contacts OK-3 in car control 80. The portion of car control 80 important to the invention is illustrated in FIG. 2.

Figure 2:
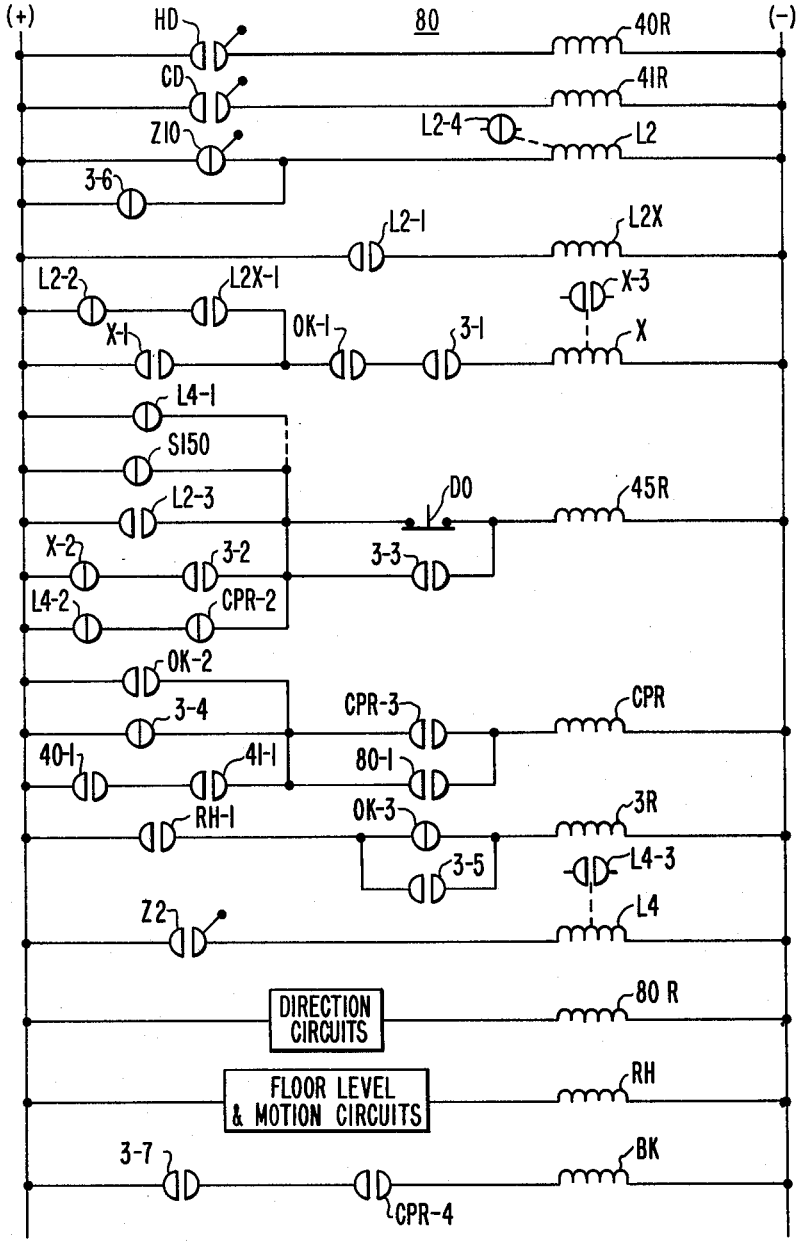
FIG. 2 is a schematic diagram of car control circuits shown in block form in FIG. 1.

More specifically, as shown in FIG. 2, relays 40R and 41R are energized only when the hatch and car doors, respectively, are closed, as monitored by switches HD and CD, respectively. Relays L2, L2X, L4 and X are associated with the door pre-opening function, and will be described in detail hereinafter. Relay 45R is the door control relay. When relay 45R is energized, the car and hatch doors will close, and when it is de-energized, they will open. Relay CPR is a relay which allows the elevator car to run when relay CPR is energized. If the car is moving with its doors open when it is de-energized, relay CPR will cause the elevator car to make an emergency stop, i.e., it will initiate the reclosing of the doors if the elevator car is not within a predetermined distance from floor level, and it de-energizes, i.e., applies the electromechanical brake 39 located in the drive machine. Relays 3R and RH are running relays. Relay 80R is a call relay which is energized when the elevator car is to make a run and the running direction has been selected. BK is the brake solenoid which applies the brake when de-energized, and which picks up the brake when energized.

Figure 3:
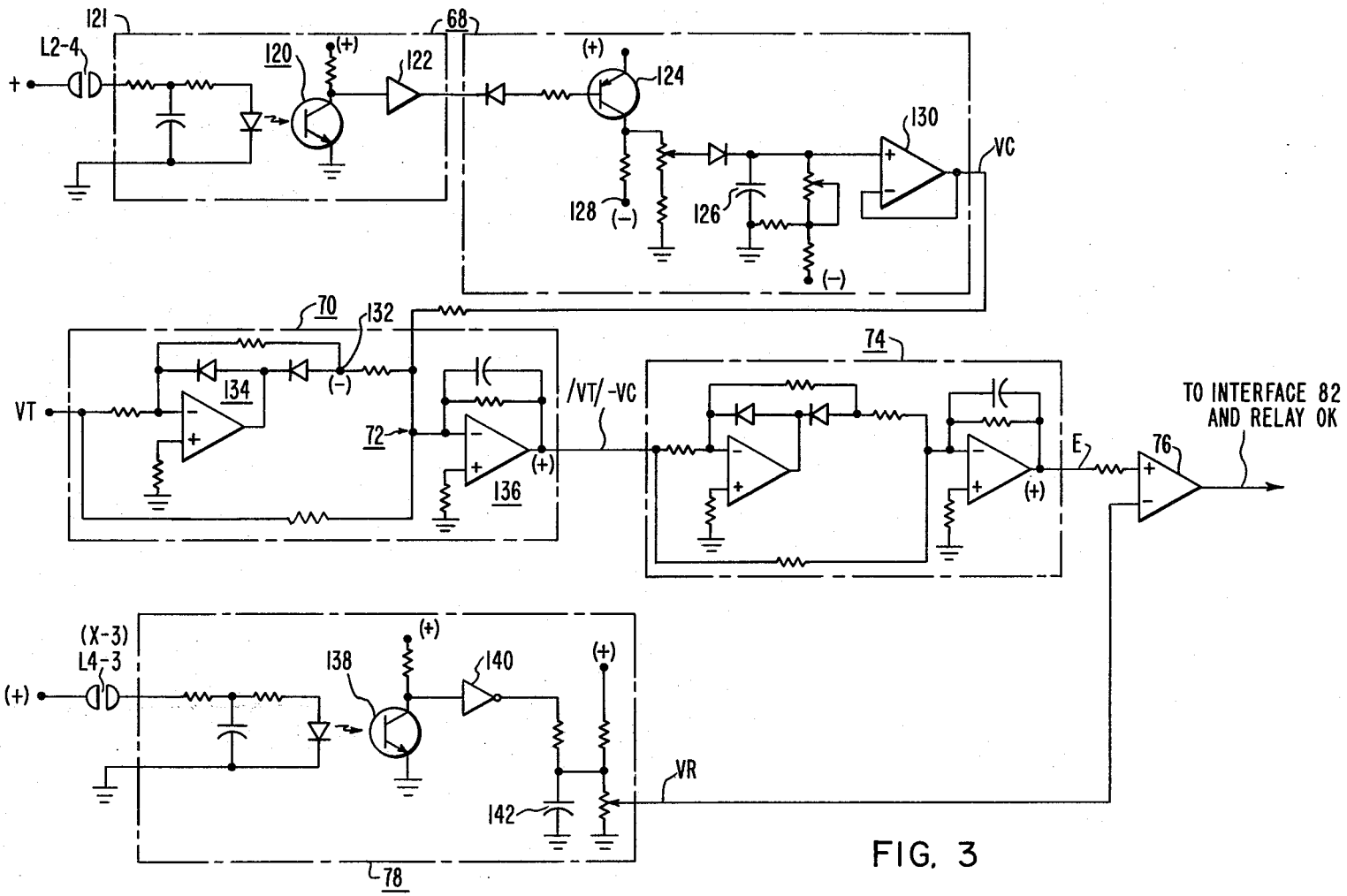
FIG. 3 is a schematic diagram of pseudo velocity and reference control circuits shown in block form in FIG. 1.

FIG. 3 is a schematic diagram illustrating detailed circuitry which may be used for certain of the functions shown in block form in FIG. 1, with certain of the contacts from the relays shown in FIG. 2 being shown in FIG. 3 in order to illustrate how the functions shown in FIG. 3 are controlled. FIGS. 2 and 3 will both be referred to in the following description.

When the elevator car 40 is to make a run, relay 80R will be energized when a travel direction has been selected, running relay RH will pick up, and running relay 3R will pick up through RH-1 and OK-3. Relay OK will be de-energized at this point, as will be hereinafter explained, as it is deliberately reset at the end of each run in order to check its operability. Relay 3R will not pick up at the start of a run, and thus the elevator car will not run, unless relay OK is de-energized, closing its contacts OK-3. When relay 3R picks up, it closes it contacts 3-2 and 3-3, and since relay X is de-energized when relay OK is deliberately dropped out at the end of a run, contact X-2 will be closed, establishing a circuit through relay 45R which initiates closing of the car and hatch doors. When the doors are closed, switches HD and CD will close to pick up door relays 40R and 41R. Contacts 40-1 and 41-1 will thus close, and since relay 80R is energized its contacts 80-1 will be closed, causing relay CPR to pick up. The elevator car will then start its run. The floor selector in the drive control 50 selects the target floor and initiates the slow-down phase of the run at the appropriate travel point.

When the elevator car approaches the target floor, position switch Z10 opens at the start of the landing zone, ten inches from the target floor, for example. Thus, relay L2 is de-energized and its contacts L2-2 close to prepare a decision circuit relative to door pre-opening, which circuit includes relay X. Contacts L2-1 open simultaneously with the closing of contacts L2-2, and approximately 50 milliseconds (Msec.) later relay L2X drops. Thus, when the elevator car 40 reaches the landing zone, a circuit by-passing open contacts X-1 is established for 50 Msec. Since contacts 3-1 are closed, the energizing of relay X during this 50 Msec. time window or period depends entirely upon the condition of relay OK. If relay OK is picked up, indicating that the actual car speed is closely tracking the design speed, contacts OK-1 will be closed and relay X will pick up and seal-in via its contacts X-1. If relay OK is not energized during the 50 Msec. time window, relay X will not pick up. The condition of relay X is used as the signal which controls the initial decision relative to pre-opening of the doors. If relay X is de-energized, the initial decision is the final decision relative to door pre-opening, i.e., door pre-opening is inhibited. Contacts X-2 and contacts 3-2 and 3-3 will retain a circuit through relay 45R, keeping the doors closed until the end of the run.

If relay X picks up during this 50 Msec. time for the initial decision, door pre-opening is enabled. If it is desired to start door pre-opening immediately, contacts L4-1 will not be required, and thus they are shown in FIG. 2 connected into the circuit via a broken line. Thus, if the car speed is less than 150 FPM, speed switch S150 will be open, contacts L2-3 will open at the ten inch point, contacts CPR-2 will be open, and thus relay 45R will drop out when contacts X-2 open, starting the opening of the doors.

If door pre-opening is not desired at the ten inch point, but at some predetermined point within the landing zone, such as at the start of the two inch zone, then contacts L4-1 will be connected as shown. Position switch Z2 closes at the two inch point energizing relay L4, which causes contacts L4-1 to open and start door pre-opening. It will be noted that if X picks up to enable door pre-opening at the ten inch point, that this initial decision to allow subsequent door pre-opening can be changed up to the start of actual door opening. This is due to the fact that as soon as the difference signal E exceeds the reference signal VR relay OK will drop out, contacts OK-1 will open, relay X will drop out, and contacts X-2 will close to maintain a circuit through door relay 45R.

If the difference signal E exceeds the reference signal VR after door pre-opening has been initiated, relay OK will drop out, causing relays X and CPR to drop out, since relays 40R and 41R are de-energized as soon as the car and hatch doors start to open. Contacts CPR-4 will open to de-energize the brake solenoid BK and drop the electromechanical brake. Also, the hoist motor is disconnected from the drive. If the elevator car is within two inches of floor level, the doors will be allowed to remain open. If the car is outside of the two-inch zone, relay L4 will be de-energized and its contacts L4-2 will be closed, establishing a circuit through door relay 45R, closing the doors.

Referring to FIG. 3, before the elevator car reaches the ten-inch landing zone, relay L2 is energized and its contacts L2-4 will be closed. This energizes an optoisolator 120 in a high voltage to logic level buffer 121 of the pseudo velocity generator 68, forcing the input to a non-inverting buffer 122 low, and thus its output is low. This turns on a PNP transistor 124 and causes a capacitor 126 to charge to a positive voltage. This voltage drives the non-inverting follower 130, which provides signal VC. When the landing zone is reached and relay L2 drops out, its contacts L2-4 open, the output of buffer 122 switches high, transistor 124 cuts off, and capacitor 126 starts discharging towards zero with a characteristic responsive to the values of capacitor 126 and the various resistors. Capacitor 126 discharges from its positive level, through zero, to a slightly negative value, and thus signal VC is reduced from its initial positive value, through zero, to a slightly negative value.

Signal VC is applied to the absolute value circuit 70, between the precision rectifier and summing portions of the absolute value circuit. The effect of signal VT responsive to the actual car speed will be negative into op amp 132, as long as the elevator car is moving, regardless of its travel direction. Signal VC will be positive during the time thus applying the difference between signals-|VT| and VC to the summing amplifier 136.

The adjustable reference control circuit 78 is responsive to contacts L4-3 when door pre-opening at the two-inch point is desired, and it is responsive to contacts X-3 (shown in FIG. 3) when door pre-opening at the ten-inch point is desired. Contacts L4-3 or X-3 will be open before door pre-opening starts. The optoisolator 138 will be non-conductive and the output of inverter gate 140 will be low. Thus, capacitor 142 will charge to a first level, providing a reference voltage VR having a first magnitude. When door pre-opening starts and contacts L4-3 or X-3 close, the optoisolator 138 conducts, and the output of inverter gate 140 goes high charging capacitor 142 to a higher level, which increases the magnitude of the reference voltage VR. Thus, it will then require a larger difference signal E to cause relay OK to drop out after the elevator doors start to open, than before preopening is initiated.

Figure 4A:
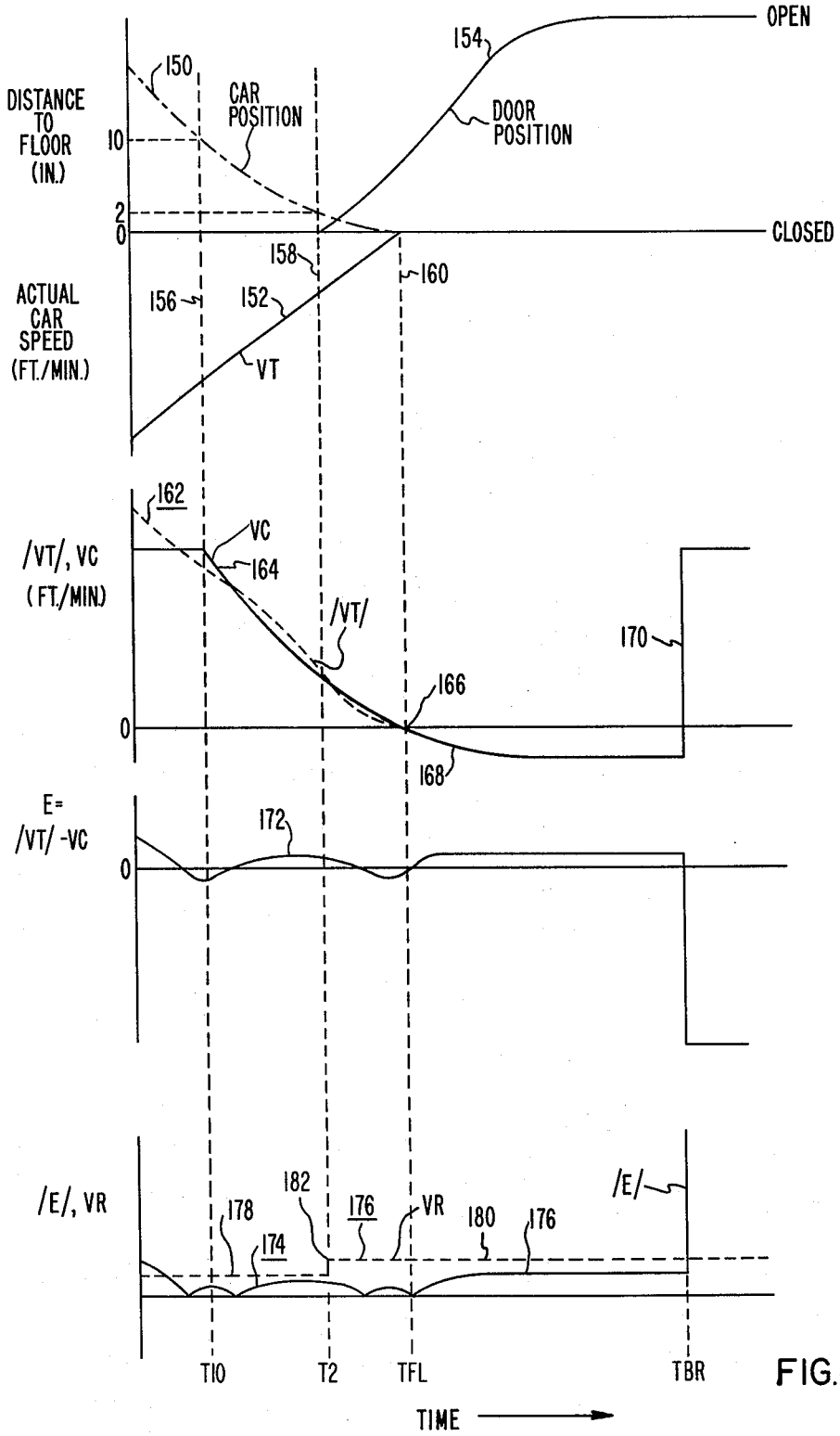
FIGS. 4A and 4B are graphs which may be assembled to illustrate certain of the signals in the elevator system shown in FIG. 1 for an example wherein door pre-opening is initiated at a point well within the landing zone.
Figure 4B:
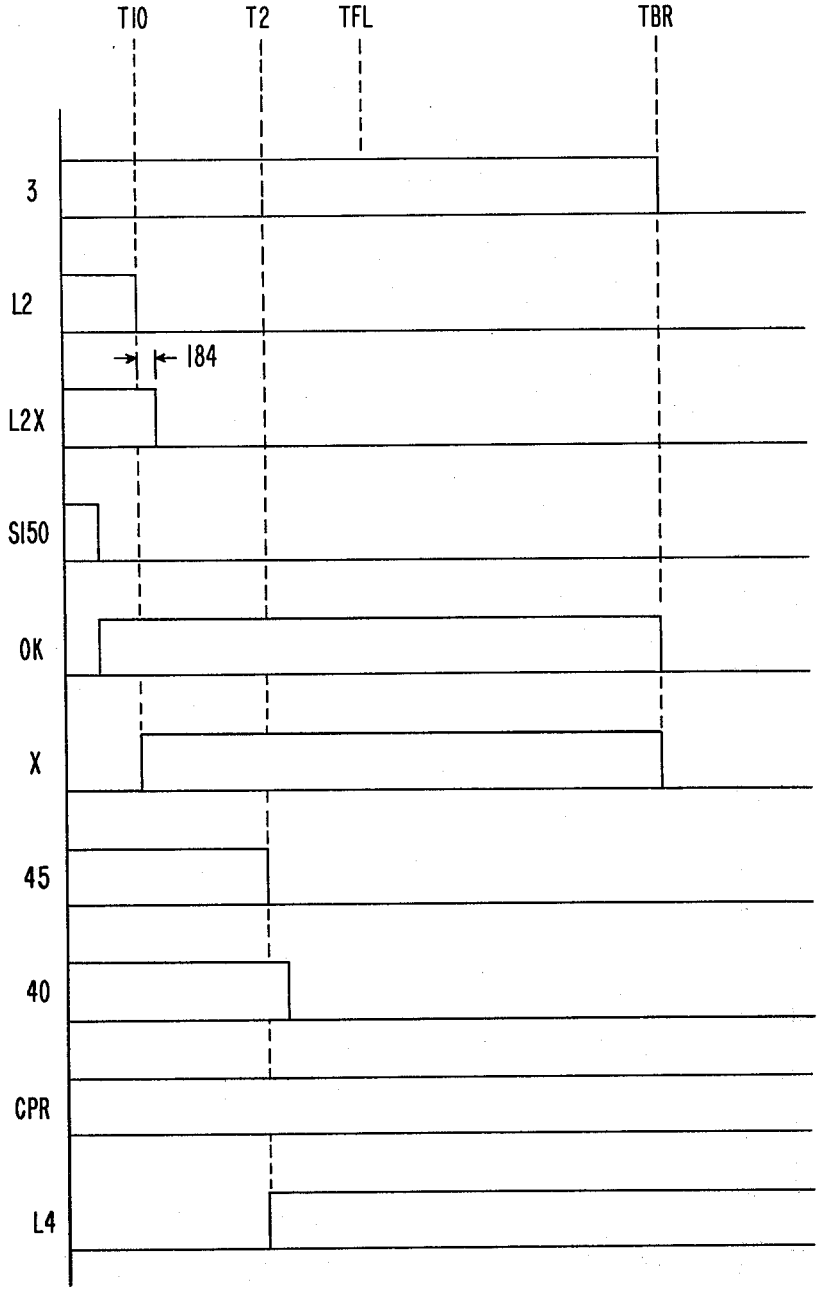
Figure 5A:
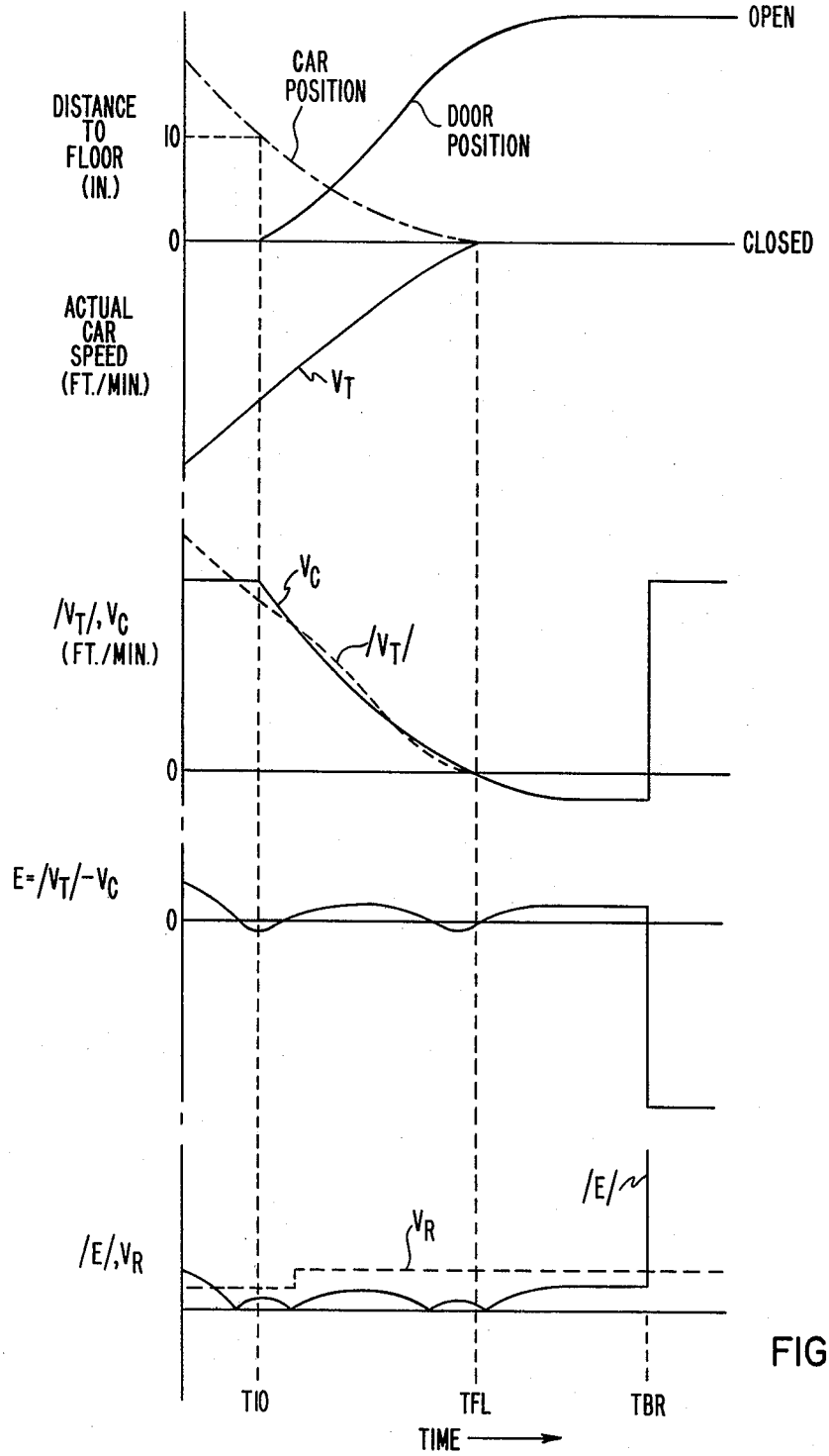
FIGS. 5A and 5B are graphs which may be assembled to illustrate certain of the signals in the elevator system shown in FIG. 1, for an example wherein door pre-opening is initiated substantially at the start of the landing zone.
Figure 5B:
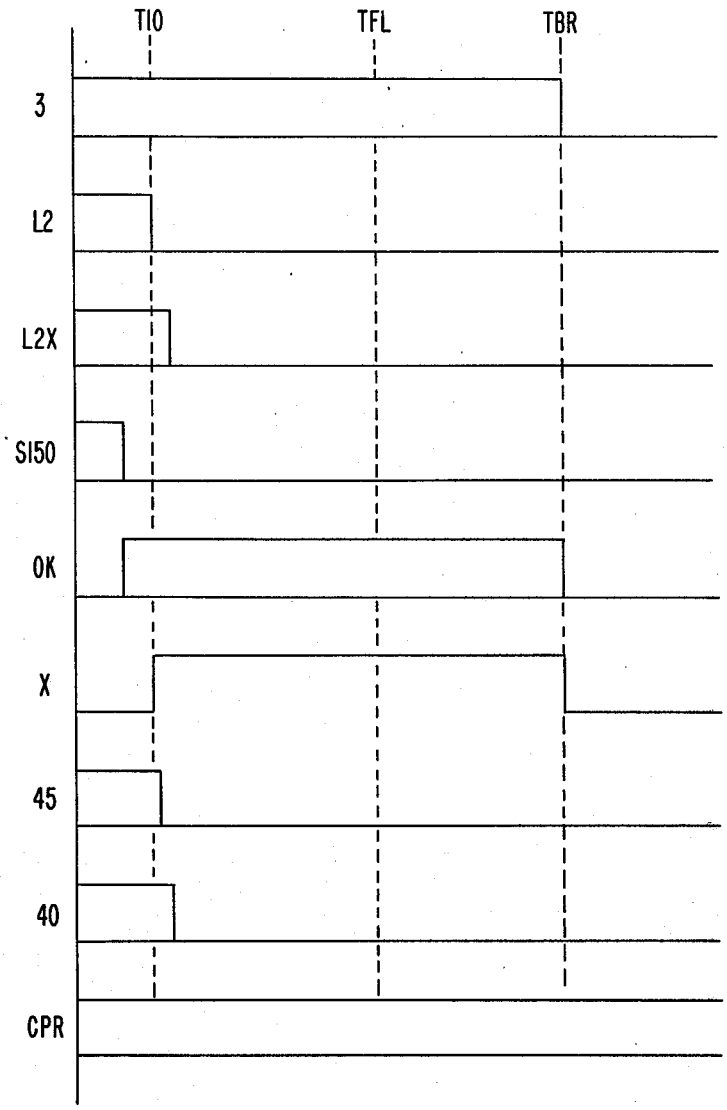

Operation of the elevator system 10 according to the teachings of the invention is graphically illustrated in FIGS. 4A, 4B, 5A and 5B. FIGS. 4A and 4B illustrate the operation with door pre-opening starting at the two-inch point, and FIGS. 5A and 5B illustrate the operation with door pre-opening starting at the ten-inch point. Curve 150 illustrates the car position relative to floor level in the landing zone versus time, curve 152 illustrates car speed VT versus time, and curve 154 illustrates the position of the elevator car door versus time. The vertical broken lines 156, 158 and 160 indicate the times when the elevator car reaches the ten-inch, the two-inch, and floor level positions, respectively.

Curve 162 indicates signal |VT| of the actual car speed, and curve 164 illustrates the design car speed VC. It will be noted that curve VC starts at a predetermined maximum positive value and it is reduced smoothly, going through zero at point 166, which point coincides with floor level when the system is operating properly. Curve 164 continues through zero to provide a negative curve portion 168. When the car enters the plus or minus ¼ inch zone, signified by the opening of the switch Z1, a one second timer is set which drops the brake when the one second expires at time $T_{BR}$. It will be noted that signal VC is then driven back to its high positive starting value at 170. The negative portion 168 reduces the maximum speed of the elevator car which will drop the brake and make an emergency stop when the elevator car is moving with its doors open after it should have been at floor level, and the return to the large positive value at 170 forces a large difference signal E in order to reset relays OK and X, which ensures their operability before allowing the elevator car to make the next run.

Curve 172 illustrates the difference signal E, curve 174 indicates the absolute value of the difference signal E, and curve 176 illustrates the two level or two step voltage reference signal VR.

Note that signal VR is initially set at a relatively low value, such as a value indicative of a deviation of 20 FPM in curve portion 178. Thus, if |E| exceeds 20 FPM at the ten-inch point, or between the ten-inch and two-inch points, door pre-opening is inhibited. If |E| remains below 20 FPM up to the two-inch point, door pre-opening is initiated and the reference voltage VR is increased to a higher level 180 at point 182, such as a magnitude indicative of a deviation of 40 FPM. Now, |E| can reach 40 FPM before an emergency stop is initiated.

It will be noted how causing signal VC to go negative after the elevator car should be at floor level provides an artificial difference signal 176 which is relative close to the reference curve 180 when the elevator car is stationary. For example, curve 176 may represent a car speed of 30 FPM. Thus, if the elevator car should land inaccurately, any subsequent movement of the elevator car after it should have been at floor level will be limited to a maximum speed of 10 FPM. A speed greater than 10 FPM will drop the electromechanical brake, and if the car is not within two inches of floor level, the door will also reclose.

FIG. 4B illustrates the operation of certain of the relays in the car control 50 shown in FIG. 2. The "time window" which allows relay X to pick up if the actual car speed is closely tracking the design speed at the start of the landing zone is indicated at 184.

Relay RH drops when the elevator car stops at floor level and the brake is applied, and relay 3R also drops out. When relay 3R drops, its contacts 3-6 close to pick up relay L2. Contacts L2-4 (FIG. 3) of relay L2 close to force signal VC high. This causes a large difference signal |E| to be produced which drops relays OK and X to reset the circuits and to allow relay 3R to pick up at the start of a run.

FIGS. 5A and 5B are similar to FIGS. 4A and 4B, except they illustrate the operation of the elevator system wherein the doors start pre-opening shortly after the ten inch point, and since they are otherwise similar they need not be explained in detail.

We claim as our invention:

1. An elevator system, comprising:

a structure having a plurality of floors, an elevator car having at least one door, motive means for moving said elevator car relative to the structure to serve the floors, means defining a landing zone adjacent to each floor, means providing a speed signal responsive to the actual velocity of the elevator car, at least while the elevator car is in a landing zone, and in the process of stopping at the associated floor, means providing a first reference signal in said landing zone when the elevator car approaches a floor at which it is to stop, responsive to the designed approach velocity of the elevator car in said landing zone, means providing a difference signal responsive to any deviation between said speed and first reference signals, means providing a second reference signal, comparator means comparing said difference and second reference signals, and providing a predetermined output signal when the difference signal exceeds said second reference signal, and means initiating pre-opening of the door of said elevator car in said landing zone before the elevator car reaches the floor at which it is to stop, in the absence of said predetermined output signal.

2. The elevator system of claim 1 including means defining an inner zone within the landing zone, and wherein the means which initiates the opening of the door of the elevator car in the absence of the predetermined output signal initiates reclosing of the door if the predetermined output signal is subsequently provided and the elevator car is not within said inner zone.

3. The elevator system of claim 1 including means defining an inner zone within the landing zone, and means changing the magnitude of the second reference signal once door opening has been initiated such that a larger difference signal is then required to cause the comparator means to provide the predetermined output signal, and wherein the means which initiates the opening of the door of the elevator car initiates the reclosing of the door if the predetermined output signal is subsequently provided and the elevator car is not within the inner zone.

4. The elevator system of claim 1 including means inhibiting pre-opening of the door of the elevator car when the predetermined output signal is provided at the start of the landing zone.

5. The elevator system of claim 1 wherein the means defining the landing zone adjacent to each floor includes first means defining the outer limits of the landing zone, and second means defining an inner zone within the landing zone, and including means which inhibits pre-opening of the door when the elevator car reaches an outer limit of the landing zone in response to the presence of the predetermined output signal, with the means which initiates pre-opening of the door initiating such pre-opening at the start of the inner zone within the landing zone when door opening has not been inhibited at the start of the landing zone and the predetermined output signal has not been provided during the time the elevator car moves from the start of the landing zone to the start of the inner zone.

6. The elevator system of claim 5 including means changing the magnitude of the second reference signal once door opening has been initiated such that a larger difference signal is then required to cause the comparator means to provide the predetermined output signal, and wherein the means which initiates the opening of the door initiates reclosing of the door if the predetermined output signal is subsequently provided and the elevator car is not within a predetermined distance from floor level.

7. The elevator system of claim 1 wherein the motive means includes a drive motor, a voltage source selectively connectable to said drive motor, and a brake, said voltage source being disconnected from the drive motor and said brake being applied when the predetermined output signal is provided when the door is open, and wherein the first reference signal starts at a predetermined polarity and magnitude at the start of the landing zone and is then reduced smoothly through zero to a predetermined magnitude of the opposite polarity, with said opposite polarity signal reducing the maximum speed at which the elevator car can then move without causing the comparator means to provide the predetermined output signal.

8. The elevator system of claim 1 including means responsive to the stopping of the elevator car at floor level for forcing the first reference signal to a relatively large magnitude, to increase the difference signal to a value which exceeds a second reference signal, causing the issuance of the predetermined output signal, and including means preventing the motive means from starting the elevator car at the start of a run unless said predetermined output signal is being provided, to provide a check on the ability of the comparator means to provide the predetermined output signal before the elevator car is allowed to move.

* * * * *